US005316070A

United States Patent [19]

Rogers et al.

[11] Patent Number: 5,316,070

[45] Date of Patent: May 31, 1994

[54] CONTROLLED CASTING OF AL-SI HYPEREUTECTIC ALLOYS

[75] Inventors: Kevin P. Rogers, Ringwood; Christopher J. Heathcock, Kew, both of Australia

[73] Assignee: Comalco Aluminum Limited, Melbourne, Australia

[21] Appl. No.: 867,113

[22] PCT Filed: Dec. 11, 1990

[86] PCT No.: PCT/AU90/00588

§ 371 Date: Jul. 2, 1992

§ 102(e) Date: Jul. 2, 1992

[87] PCT Pub. No.: WO91/02100

PCT Pub. Date: Feb. 21, 1991

[30] Foreign Application Priority Data

Dec. 11, 1989 [AU] Australia ..... PJ7821
Dec. 11, 1989 [AU] Australia ..... PJ7822

[51] Int. Cl.[5] ..... B22D 21/04; B22D 25/06; B22D 27/04

[52] U.S. Cl. ..... 164/122; 164/125; 164/126; 164/135

[58] Field of Search ..... 164/122, 122.1, 125, 164/126, 127, 128, 135

[56] References Cited

U.S. PATENT DOCUMENTS 4,875,518 10/1989 Imura et al. ..... 164/122.1
4,976,305 12/1990 Tanaka et al. ..... 164/154

FOREIGN PATENT DOCUMENTS 2361934 6/1974 Fed. Rep. of Germany ..... 164/135
0084639 5/1983 Japan ..... 164/122
0053756 3/1989 Japan ..... 164/122.1
0202354 8/1989 Japan ..... 164/135

*Primary Examiner*—Paula A. Bradley
*Assistant Examiner*—Erik R. Puknys
*Attorney, Agent, or Firm*—Larson and Taylor

[57] ABSTRACT

Al base - Si hypereutetic alloys can exhibit problems of variable and unwanted microstructure throughout the section of the article being cast. This problem is overcome by controlled cooling of the mold in critical areas, to remove or prevent excessive accumulation of heat energy and avoid the formation of intense convection currents in still molten alloy. Consequently, the necessary coupled growth of the Al-Si eutectic is promoted and the resultant microstructure is substantially free of primary Si. The 3HA and modified 3HA alloys of the applicant are considered on the basis of their wear resistance and improved machineability for automotive applications, such as engine blocks and cylinder heads. A first feature of the controlled cooling procedure is supply of coolant to regions in the mold, above and extending from the gate, such that solidification progresses uniformly from the remote regions of the mold spaces towards the gate to give a substantially uniform microstructure throughout the casting. Various coolants may be used, so that temperature in the vicinity of the gate is 50°-75° C. above those at the extremities. A second feature of the controlled cooling procedure consists of supplying melt to the mold cavity through a plurality of gates, spaced relative to one another in the critical control region of the mold. The result of using such a plurality of gates, is that the energy accumulated is more widely distributed in a plurality of critical control regions, in order to achieve the necessary temperatures at the remote and gate regions and temperature differentials between these.

24 Claims, 7 Drawing Sheets

CONTROLLED CASTING OF AL-SI HYPEREUTECTIC ALLOYS

This invention relates to an improved process for the production of articles by permanent mould casting of hypereutectic Al-Si alloys. The invention is applicable to the casting of articles by use of gravity and pressure fed permanent and semi-permanent moulds (hereinafter collectively referred to as "permanent moulds").

In recent times, there has been substantial interest in the use of hypereutectic Al-Si alloys, in particular in automotive applications such as for the production of engine blocks and cylinder heads. Examples of alloys considered include our 3HA alloy as disclosed in our Australian patent specification 536976 (and corresponding patents and applications in other countries), and versions of modified 3HA alloy as disclosed in our International patent specifications PCT/AU89/00054 and PCT/AU90/00341. The interest in alloys of the general class encompassing 3HA and modified 3HA alloys is attributable to their wear resistance and, in the specific case of 3HA and modified 3HA alloys, also their improved machinability.

With hypereutectic Al-Si alloys in general, the presence of primary Si particles reduces the machinability of cast articles. Known wear resistant alloys of that general type have been proposed to overcome this problem and to achieve superior wear resistance. Our 3HA and modified 3HA alloys are considered to provide further substantial advances in terms of wear resistance, as well as machinability and control of primary Si formation.

In permanent mould casting of hypereutectic Al-Si alloys, we have found that a particular problem can occur, at least in some instances. For example, while our 3HA and modified 3HA alloys can be used for the production of complex articles by a wide variety of casting techniques, some difficulty still can be encountered with some articles produced by permanent mould casting. Where this is the case, the casting can be found to be characterised by a microstructure which varies between regions of the article, with the variation being considerable in some instances. Thus, with engine blocks produced by conventional low pressure casting techniques, the microstructure in regions above the gates can be unmodified and contain many primary Si particles grading through to regions remote from the gates in which the microstructure is modified and contains few if any primary Si particles.

The variation in microstructure is found not to be able to be eliminated by normal variation in metal temperature, mould or core preheat temperature or mould fill rate, while little if any improvement is achieved with variation in section thickness. However a slight, but insufficient, improvement is found with lower metal temperatures and also lower mould or core preheat temperature.

We have found that the problem of microstructure variation can be overcome by the present invention which entails modification of the casting operation. Also, while the problem encountered with use of our 3HA and modified 3HA alloys can be overcome by the process of the present invention, we have found that the invention also can be used with some benefit in producing articles from other hypereutectic Al-Si alloys.

Our research has shown that the problem addressed by the present invention is in part attributable to an accumulation of heat, in what is herein referred to as the control region of the mould, a region above and extending upwardly from the gate, during an operating cycle of a permanent mould casting operation. As a consequence of such heat accumulation, the temperature of the mould in the control region progressively increases and approaches the temperature of the melt. Due to this, the solidification rate of alloy above and extending from the gate, within the control region of the mould cavity, is insufficient to enable attainment of a microstructure which is substantially the same as that of the remainder of the casting. The heat accumulation in the control region may not be detrimental in an initial operating cycle or initial few cycles but, if this is the case, it is found to become progressively more detrimental with successive cycles until an undesirable equilibrium heat level is attained.

Our research further indicates that convection in the control region is a contributing factor. Strong convection currents are found to be generated in that region, and that these currents are maintained for substantial periods after filling the mould while the metal still is liquid. In addition, it appears that the velocity of the convection currents increases with increasing accumulation of heat in the control region and that, in general, the adverse consequences of such currents are encountered only when the accumulation of heat energy in the control region is excessive. The convection currents, when of sufficient intensity, disrupt coupled growth of the eutectic and promote the nucleation and growth of primary Si. In remote regions of the mould, convection currents are found not to achieve an intensity sufficient to disrupt such coupled growth.

The present invention provides a process for producing an article of an Al-Si hypereutectic alloy, in which the article is produced by feeding a melt of the alloy to a permanent mould to fill a cavity of the mould through at least one gate, with flow of the melt to remote regions of the cavity through a region of the mould (herein referred to as the "control region") which extends above and upwardly from the or each gate, wherein (a) the temperature in the control region is maintained below an upper level, and (b) a temperature differential between the remote regions and the control region is controlled, such that:

(i) solidification of the melt in the mould is from the remote regions to the gate, through a portion of the melt (herein referred to as the "control portion") within the control region of the mould; and (ii) the solidification proceeds substantially throughout the cavity, by coupled growth of eutectic, to achieve substantially throughout the resultant article a microstructure comprising modified eutectic.

The required temperature in the or each control region, and control over the temperature differential, principally are by extraction or distribution of heat energy from the or each control region of the mould. The heat energy preferably is extracted or distributed such that the article has a substantially uniform microstructure throughout. In this regard, uniformity primarily is with respect to constituents of the microstructure, but most preferably also with respect to size. Thus, with the use of 3HA or modified 3HA alloy, the microstructure is substantially of modified eutectic throughout and preferably substantially free of primary Si particles. The eutectic cell size, and also the size of any primary Si particles formed, most preferably also is substantially uniform throughout. In general, such eutectic microstructure substantially free of primary Si particles can be achieved with use of other Al-Si hypereutectic alloys to which the invention relates, such as those detailed herein, and again it is possible to attain substantial uniformity of constituents of the microstructure and size uniformity. However, in each case, the heat energy extraction or distribution from the control region or regions of the mould is such that the melt in substantially all regions of the die cavity is able to solidify without strong convection currents and with a sufficient temperature gradient, and sufficient resultant growth rate, to achieve coupled growth of Al-Si eutectic, with a substantially uniform eutectic structure being attained throughout.

In operating in accordance with the invention, the temperature of the mould preferably is monitored at the control region, and preferably also at remote regions. Thus, thermocouples can be provided in the mould, at such locations, in close proximity to, such as about 2 mm from, the surface of the mould cavity. As indicated, the temperature differential between remote and control regions, and the temperature of the or each control region, must be such as to achieve directional solidification from remote regions of the mould, back through the control region, to the gate; the remote regions typically being at the top of the mould. For this, and also the required modified eutectic throughout the resultant article, it generally is necessary that the control region is at a temperature above that of the remote regions by at least 50° to 75° C., preferably by at least 100° C. Typically, it is necessary that the remote regions of the mould such as the top of the mould, on completion of filling the mould cavity, are at a temperature of from 150° to 350° C., preferably from 200° to 350° C. and most preferably from 300° to 350° C. The control region of the mould preferably is at a temperature of from 350° to 520° C., such as to a temperature of from 400° to 480° C. and most preferably from 400° to 475° C. such as from 400° to 450° C. The melt feed temperature preferably is as low as possible. However, at least for 3HA and modified 3HA alloys, the melt should be no lower than 700° C., and preferably is no lower than 720° C., as received in the die cavity.

In a first embodiment of the present invention, the required temperature differentation and control region temperature are achieved by use of a fluid coolant. In this embodiment, the coolant is caused to flow through the control region, with the flow of coolant being adjusted to extract heat energy from the control region.

The flow of coolant is initiated, or at least raised to a required level, on completion of filling the mould cavity. That is, substantial heat energy extraction by the flow of coolant is required on or shortly after completion of filling of the mould cavity. Heat extraction by the coolant before completion of filling generally is undesirable, as it can result in excessive cooling of at least part of the melt passing through the control region. Most preferably the flow of coolant is initiated after a short interval following the completion of filling of the mould cavity. The mould is allowed to stand during that interval to reduce turbulence from filling, to dissolve smaller Si particles formed in the melt during filling of cooler regions of the mould cavity, and to achieve a degree of temperature equalization throughout the cavity. The period of standing can range from a few seconds, such as about 5 seconds, where the article being cast is relatively small, up to about 10 seconds for relatively large articles such as an engine block.

The first embodiment of the invention is a departure from conventional practice in its requirement for application of coolant. In conventional practice, cooling, such as by a coolant, is applied at one or more locations remote from the gate to initiate and encourage progressive solidification from the extremities of the mould cavity back to the gate. In the present invention, the coolant is applied to a mould control region above and extending from the gate, but such that the maximum temperature prevailing in the control region is compatible with the avoidance of intense convection currents and attainment of coupled growth, during solidification of the melt, throughout substantially the entire mould cavity, thereby achieving a substantially uniform microstructure throughout. The control of the temperature prevailing in the control region is such that solidification of the melt progresses to the gate from regions of the cavity remote from the gate. However, the control also is such that excessive cooling of the melt in the control portion does not occur in advance of such solidification, and such that shrinkage and resultant porosity in the casting is precluded.

The departure from conventional practice, by extraction of heat energy by fluid coolant passed through the control region of the mould above and extending from the gate, should not be confused with conventional cooling at or below the gate to freeze off the metal feed to the mould. Such cooling to freeze off the feed of course is for an entirely different purpose and does not achieve cooling of the control region of the mould required by the present invention. Cooling to freeze off the feed, or other conventional practice to free the resultant article from the feed, still is required with the present invention.

A suitable fluid coolant may comprise air or nitrogen. However, it may comprise a liquid such as water, water containing a dissolved salt or other compound to increase its thermal capacity, oil, or a water/oil mixture. Additionally, such coolant may comprise a liquid mist such as of water or oil carried by a gas stream. Where the requirement for cooling is relatively minor, gas such as air can be used. A liquid mist such as air-borne water mist is preferred because of its greater cooling capacity but, as will be appreciated, use of a water or oil mist necessitates careful sealing and venting precautions for the safety of operators during a casting operation. While water or oil can be used, it is less preferred because of the more exacting requirements for its safe use in the vicinity of molten metal, and its higher level of thermal efficiency compared with a liquid mist normally is not required.

While fluid coolant flow follows completion of filling of the mould cavity, it is desirable to commence gas flow through the control region of the mould, before commencing liquid flow, where a liquid mist is used. Similarly, the liquid flow preferably is terminated in advance of terminating the gas flow on completion of cooling. Also, with use of a liquid mist or a liquid per se as coolant, it is preferable to use a liquid of lower cooling power such as an oil, rather than a liquid of higher cooling power such as water, where there is a risk of mould failure due to thermal shock.

In a second embodiment of the present invention, the melt is fed to the cavity through a plurality of gates spaced relative to each other through a respective control region of the mould. Each control region extends above and upwardly from its gate, with the number of and spacing between the gates resulting in heat energy from each control region being distributed to other regions of the mould such that the required temperature differential for each control region and temperature for each control region are attained.

In one form of the invention, the second embodiment is used in combination with the first embodiment. In such combination, the coolant can be as described above. However, as there is both heat energy extraction by the coolant and heat energy distribution by the gate arrangement of the second embodiment, use of a coolant gas such as air can suffice.

The second embodiment is a departure from conventional practice in its requirement for a plurality of gates spaced relative to each other such that heat energy is distributed from the control regions to other regions of the mould. In common practice, there typically is a single gate or two closely adjacent large gates at which adverse heat accumulation occurs in the control region above the or each gate. With some large castings produced by conventional procedures, at least two gates are used, but these are to ensure efficient and complete filling of all regions of the mould cavity, with the flow of melt through each of those gates resulting in adverse heat accumulation in the control region of each. As Previously indicated in relation to the first embodiment, conventional practice more typically utilises cooling, such as by a coolant, at one or more locations remote from the or each gate, to initiate and encourage progressive solidification from the extremities of the mould cavity back to the gate, and does not address the problem the present invention overcomes. In the second embodiment, the number and positioning of the gates is adjusted such that the maximum temperature prevailing in the control regions is compatible with avoidance of intense convection currents and attainment of coupled growth, during solidification of the melt, throughout substantially the entire mould cavity, thereby achieving a substantially uniform microstructure throughout. The control of the temperature prevailing in the control region is such that solidification of the melt progresses to the gates from regions of the cavity remote from the gate. However, the control also is such that excessive cooling of the melt in the control portion does not occur in advance of such solidification, and such that shrinkage and resultant porosity in the casting is precluded.

As will be apparent from the above, the problem addressed by the invention arises from excessive temperatures developed at the control region of the mould during a cycle, or successive cycles, of operation. This is attributable to the volume of melt which feeds through the gate and the control region in a casting operation. That is, all of the melt at high temperature passes through the gate of a single gate mould, and through or into the control region of the mould cavity, causing substantial heat energy accumulation in the control region of the mould. With a mould having two or more gates, a lesser volume of the melt is involved at each gate, although a similar consequence results, particularly where the gates are closely adjacent each other. Also, with one or more than one gate, heat energy accumulation can be exacerbated during successive cycles of operation in the one mould.

The heat accumulation in the control region of the mould, which the present invention is directed to overcoming, results in that portion of the melt passing to portions of the mould cavity remote from the gate being reduced in temperature. Thus, melt passing to the remote portions of the mould cavity is at a temperature at which it can solidify without generation of intense convection currents and with the required coupled growth despite coupled growth not being possible in the control portion of the cavity in the absence of heat energy extraction from the control region of the mould. However, utilisation of heat energy extraction or distribution from the control region or regions of the mould requires attainment of a critical balance in order to:

(i) ensure that generation of intense convection currents in the control region is avoided, such that solidification by coupled growth of eutectic is retained in the remote portions of the mould cavity, but with such growth also being attained in the control portion or portions of the cavity; and (ii) overall solidification is from the remote portions back to the gate or gates.

If the level of heat energy extraction or distribution from the control region(s) of the mould is too low, primary silicon formation occurs or is excessive, principally in the or each control portion of the mould cavity, with the adverse consequences detailed above. If the level of heat extraction or distribution (with allowance for heat dissipation) is too high, primary Al dendrites form, with adverse consequences for the mechanical properties for the resultant article, especially wear resistance.

If the level of heat extraction or distribution is too high, Sr-rich intermetallic phases in the form of platelets rather than as desired equi-axial, blocky Particles will result. These platelets have adverse effects on tensile, fatigue and impact strength. Excessive cooling at the control region(s) may also lead to premature freezing of the feeding system, causing porous castings. However, while heat energy extraction or distribution is from the control region or regions of the mould above the or each gate, the window for the necessary solidification conditions must prevail throughout substantially the entire mould cavity.

Thus, the level of heat extraction above the or each gate is to be within relatively narrow constraints. It is to be such that a substantially uniform microstructure is obtained throughout the article or casting by coupled growth of Al-Si eutectic. Also, the required thermal gradient is to be obtained such that solidification of the melt proceeds from remote regions of the mould cavity to the or each respective gate. However, the heat extraction or distribution is to be such as not to overcool the melt at the or any gate and thereby freeze of the melt at or above the gate with resultant shrinkage of, and porosity in, the casting.

While the present invention is applicable to hypereutectic Al-Si alloys in general, its principal application is in respect of such alloys having from 12 to 16 wt % Si. The Si content preferably is from 13 to 15 wt %. Below about 12 wt % Si, the alloy of course will not be of the required hypereutectic form, for which coupled growth of eutectic is possible so as to achieve a microstructure substantially comprising modified eutectic. With Si in excess of about 16 wt %, there is increasing difficulty in achieving such microstructure substantially free of primary Si particles, while the size and number of those particles tends to become excessive.

The requirement for a microstructure substantially comprising modified eutectic necessitates that the alloy contains an Si modifier. The modifier preferably is Sr, but alternatives for Sr can be used as detailed with reference to our International patent application PCT/AU90/00341 filed on 9 Aug. 1990. The full disclosure of the specification of said PCT/AU90/00341 is hereby incorporated in and is to be read as part of the disclosure of the present invention, particularly in relation to such alternatives for Sr. Where Sr is used as the Si modifier, it preferably is present at a level in excess of about 0.1 wt % up to about 0.35 wt %, while alternatives for Sr preferably are used at a level as disclosed in said PCT/AU90/00341. With less than 0.1 wt % Sr or its equivalent for an alternative, modification of eutectic Si is not achieved. While more than 0.35 wt % Sr, or an excess equivalent for alternatives as allowed in said PCT/AU90/00341, can be used, no further beneficial effect is achieved in terms of controlling primary Si formation. More than 0.35 wt % Sr, or an excess equivalent for such alternatives, also tends to result in an excessive volume fraction of intermetallic particles, such as $Al_2Si_2Sr$. With Sr in excess of about 0.05 wt %, increasing levels of such intermetallic particles are present, with control of the morphology of those particles being achieved by use of Ti as disclosed in our above-mentioned PCT/AU89/00054, or an alternative for Ti as disclosed in said PCT/AU90/00341.

Ti or its equivalent preferably is included in the alloy used for the present invention, at least for the basic purpose of improving castability and to improve mechanical properties of the alloy. Such addition in the established Al-Ti-B master alloy form, which provides compounds such as $(Al,Ti)B_2$, $TiB_2$, $TiAl_3$ or similar forms, is preferred. However, the addition can alternatively be as, for example, TiC or TiN. Such boride, carbide or nitride form for addition of Ti also is applicable to alternatives for Ti. The level of addition of Ti can be and preferably is as detailed in the specification of said PCT/AU89/00054, the disclosure of which is hereby incorporated herein by reference. However, the level of addition of Ti or an alternative for Ti can be as disclosed in said PCT/AU90/00341.

The alloy preferably is one as disclosed in PCT/AU89/00054 or PCT/AU90/00341. However, subject to one proviso, other suitable alloys are those of our Australian patent 536976, the disclosure of which is hereby incorporated herein by reference. The one proviso is that Si modifier is used at a level specified in each of PCT/AU89/00054 or PCT/AU90/00341, or that a primary Si refiner is used as detailed below.

The alloy of said patent 536976 is as follows:

| | General (wt %) | Preferred (wt %) |
|---|---|---|
| Si | 12–15 | 12–15 |
| Cu | 1.5–5.5 | 1.5–4.0 |
| Ni | 1.0–3.0 | 1.0–3.0 |
| Mg | 0.1–1.0 | 0.4–1.0 |
| Fe | 0.1–1.0 | 0.1–0.5 |
| Mn | 0.1–0.8 | 0.1–0.8 |
| Zr | 0.01–0.1 | 0.01–0.01 |
| Modifier | 0.001–0.1 | 0.01–0.05 |
| Ti | 0.01–0.1 | 0.01–0.1 |
| Al | Remainder * | Remainder * |

* Note: apart from incidential impurities.

The modifier in said alloy of patent 536976 preferably is Sr but, if used, needs to be at a level in excess of 0.1 wt % as detailed in PCT/AU89/00054. The alloy typically is prepared by establishing a melt of the required composition and solidifying the melt under conditions such that the growth rate R of the solid phase during solidification is from 150 to 1000 μm/sec and the temperature gradient G at the solid/liquid interface is such that the ratio G/R is from 500° to 8000° Cs/cm$^2$. The alloy, when solidified typically is of essentially eutectic microstructure containing not more than 10% of primary α-Al dendrites and substantially free from intermetallic particles exceeding 10 μm in diameter.

A generalised version of the alloy of said patent 536976 is suitable for use in the present invention, subject to the same proviso in relation to Si modifier. In such generalized alloy, the Si content can range from 12 to 16 wt %. P can be present at up to 0.05 wt %, but preferably is limited to a maximum of 0.003 wt % to avoid possible formation of primary Si. Ca can be present at up to 0.03 wt %, but preferably is limited to a maximum of 0.003 wt % to avoid adverse consequences for melt fluidity and eutectic modification. Additionally, in such generalised version, Ni, Zr and Ti can be omitted, if required to limit the level of intermetallic particles.

The alloy disclosed in said PCT/AU89/00054 contains Sr in excess of 0.10% and Ti in excess of 0.005%, the alloy further comprising:

| | | | |
|---|---|---|---|
| Cu | 1.5 to 5.5% | Pb | 0 to 0.2% |
| Ni | 1.0 to 3.00% | Cr | 0 to 0.1% |
| Mg | 0.1 to 1.0% | Na | 0 to 0.01% |
| Fe | 0.1 to 1.0% | B (elemental) | ≦0.05% |
| Mn | 0.1 to 0.8% | Ca | ≦0.003% |
| Zr | 0.01 to 0.1% | P | ≦0.003% |
| Zn | 0 to 3.0% | Others | ≦0.05% each, |
| Sn | 0 to 0.2% | | |

the balance, apart from incidental impurities, being Al; wherein the level of Sr in excess of 0.10% and Ti in excess of 0.005% is such that the alloy has a microstructure in which any primary Si formed is substantially uniformly dispersed and is substantially free of segregation, and in which substantially uniformly dispersed Sr intermetallic particles are present but are substantially free of such particles in the form of platelets, the microstructure predominantly comprising a eutectic matrix.

In that broadly designated alloy of PCT/AU89/00054, Sr preferably is present at a level of from 0.11% to 0.4%, and most preferably at a level of from 0.18% to 0.4% such as from 0.25% to 0.35%. Ti preferably is present as at least one of $(Al,Ti)B_2$, $TiB_2$, $TiAl_3$, TiC and TiN, provided that not more than 0.1% Ti is provided as any of $(Al,Ti)B_2$, $TiB_2$ and mixtures thereof, with not more than 0.25% Ti most preferably being provided. Preferably Ti is present at a level of from 0.01% to 0.06%, and most preferably at a level of from 0.02% to 0.06% such as from 0.03% to 0.05%. The alloy, in addition to Sr and Ti, may comprise:

| | | | |
|---|---|---|---|
| Cu | 1.5–5.5% | Fe | 0.1–1.0% |
| Ni | 1.0–3.0% | Mn | 0.1–0.8% |
| Mg | 0.1–1.0% | Zr | 0.01–0.1% |

the balance, apart from impurities, comprising Al.

The alloy of said PCT/AU89/00054, when used in the present invention, can be varied in its Si content such that Si is present at from 12 to 16 wt %. Also, the content of Ca and P preferably are as indicated, but Ca can be increased to a maximum of 0.03 wt %, while P can be increased to a maximum of 0.05 wt %.

The composition of the alloy disclosed in said PCT/AU90/00341 has 12% to 15% Si, and elements A, X and Z with the balance, apart from incidental impurities, being Al; the alloy having at least one element X and at least one element Z in excess of a respective predetermined level for each such that the alloy has a microstructure in which any primary Si present is substantially uniformly dispersed, with the microstructure predominantly comprising a eutectic matrix; and the elements A comprising:

| | | | |
|---|---|---|---|
| Cu | 1.5 to 5.5% | Pb | 0 to 0.2% |
| Ni | 1.0 to 3.0% | Cr | 0 to 0.1% |
| Mg | 0.1 to 1.0% | Si modifier | 0.001 to 0.1% |
| Fe | 0.1 to 1.0% | (Na, Sr) | |
| Mn | 0.1 to 0.8% | B (elemental) | 0.05% maximum |
| Zr | 0.01 to 0.1% | Ca | 0.03% maximum |
| Zn | 0 to 3.0% | P | 0.05% maximum |
| Sn | 0 to 0.2% | Others | 0.05% maximum each. |

The element X is at least one selected from a group providing stable nucleant particles in a melt of the alloy. The element Z comprises at least one selected from a group which forms an intermetallic phase. The element X is not solely Ti where element Z is solely Sr.

The element X may be selected from the group comprising Cr, Mo, Nb, Ta, Ti, Zr, V and Al. Elemental X may be present at a level in excess of 0.005 wt %, such as from 0.01 to 0.20 wt %, except that where the element X is Ti added as an Al-Ti-B master alloy the upper limit preferably does not exceed 0.1 wt %. The element X may be, or include, Ti, present at a level of from 0.01 to 0.06%, such as from 0.02 to 0.06%, for example from 0.03 to 0.05%. However, element X may be, or include at least one of, Cr, Mo, Nb, Ta, Zr, V and Al at a respective selected level of 0.005 to 0.25%, such as from 0.005 to 0.2%, for example from 0.01 to 0.2%; preferred levels being:

| | | | |
|---|---|---|---|
| Cu | 0.02 to 0.10% | Zr | 0.05 to 0.10% |
| Mo | 0.02 to 0.10% | V | 0.05 to 0.15% |
| Nb | 0.02 to 0.10% | Al | 0.01 to 0.15% |
| Ta | 0.02 to 0.10%. | | |

The element Z may be selected such that the intermetallic phase is ternary or higher order phase of the form Al-Si-Z' or Al-Z', where Z' is at least one element Z. The element Z may be selected from Ca, Co, Cr, Cs, Fe, K, Li, Mn, Na, Rb, Sb, Sr, Y, Ce, elements of the Lanthanide series, elements of the Actinide series, and mixtures thereof. The selected element Z preferably is at a level of:

| | | | |
|---|---|---|---|
| Ca | 0.9 to 2.0 wt % | Na | 0.1 to 0 4 wt % |
| Co | 0.5 to 3.0 wt % | Rb | 0.1 to 0.4 wt % |
| Cr | 0.5 to 1.0 wt % | Sb | 0.5 to 2.0 wt % |
| Cs | 0.1 to 0.4 wt % | Sr | 0.11 to 0.4 wt % |
| Fe | 1.5 to 2.0 wt % | Y | 0.5 to 3.0 wt % |
| K | 0.1 to 0.4 wt % | Ce | 0.5 to 3.0 wt % |
| Li | 0.1 to 0.4 wt % | Others | 0.5 to 3.0 wt % |
| Mn | 1.0 to 2.0 wt % | | |

The alloy of PCT/AU90/00341, when used in the present invention, also can be varied in its Si content such that Si is present at from 12 to 16 wt %. Also, the content of Ca and P preferably are as indicated, but Ca can be increased to a maximum of 0.03 wt %, while P can be increased to a maximum of 0.05 wt %.

The fluid coolant passed through the control region of the mould in the first embodiment is controlled so as to achieve the required heat extraction from that region. Similarly, the number and spacing between gates of the mould in the second embodiment is established for a given casting to be made so as to achieve the required heat distribution from each control region. As will be appreciated, the heat extraction or distribution is to ensure appropriate solidification conditions within the control zone of the mould cavity, whilst maintaining such conditions in more remote regions of the cavity. The solidification conditions in the or each control region can range from relatively low solidification rates to relatively high solidification rates. The former case is illustrated by a solid phase growth rate R of below about 150 μm/sec, such as below about 75 μm/sec, at a thermal gradient G of less than about 7.5° C./cm. Below these conditions of R less than 150 μm/sec and G less than 7.5° C./cm, formation of primary Si is favoured, and lower solidification rates for the or each control portion of the mould cavity are acceptably only in so far as chemical control of primary Si formation can be achieved by appropriate higher levels of Sr and Ti or their equivalents. High solidification rates, with R above 150 μm/sec up to about 800 μm/sec and with G above 10° C./cm will give rise to modified eutectic and possibly increased Sr intermetallic platelets towards the higher end of the growth rate range, while dendrite formation may also occur. Very high solidification rates, with R at or above 1000 μm/sec and G at or above 800° C./cm will result in substantial dendrite formation and a greater volume fraction of Sr intermetallic platelets relative to equi-axial, blocky, Sr intermetallic particles. However, within such constraints on solidification conditions, attainment of the required microstructure can be achieved by an appropriate combination of control over heat energy extraction or distribution and chemical means.

In order to further illustrate the present invention, the following description details specific Examples of embodiments of the invention. That description also is with reference to the accompanying Figures, in which.

Figure 4:
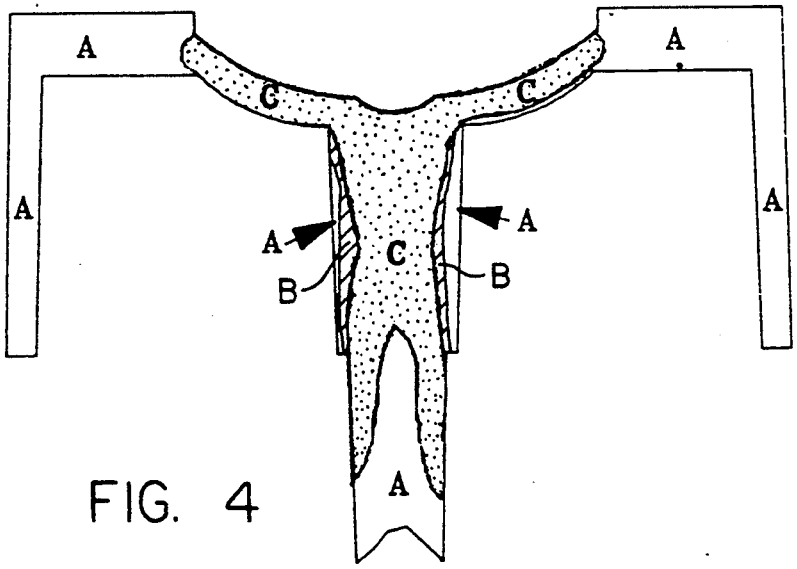
Figure 5:
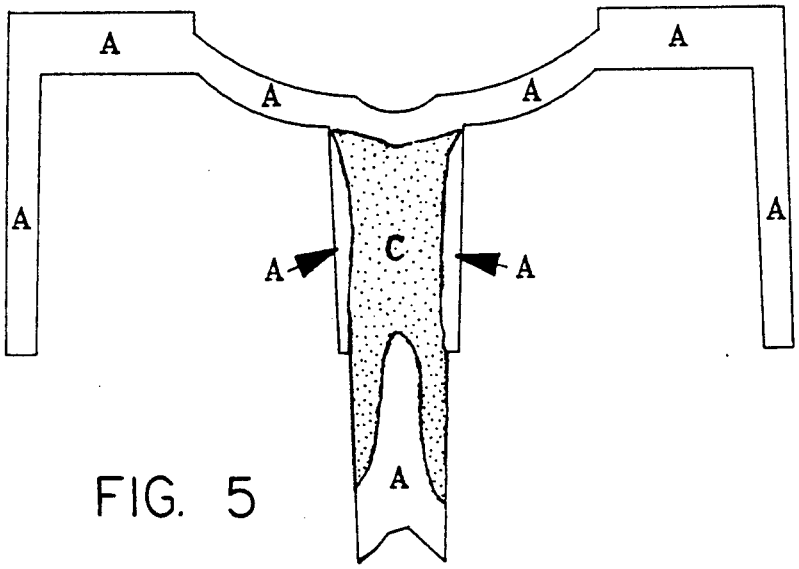
Figure 6:
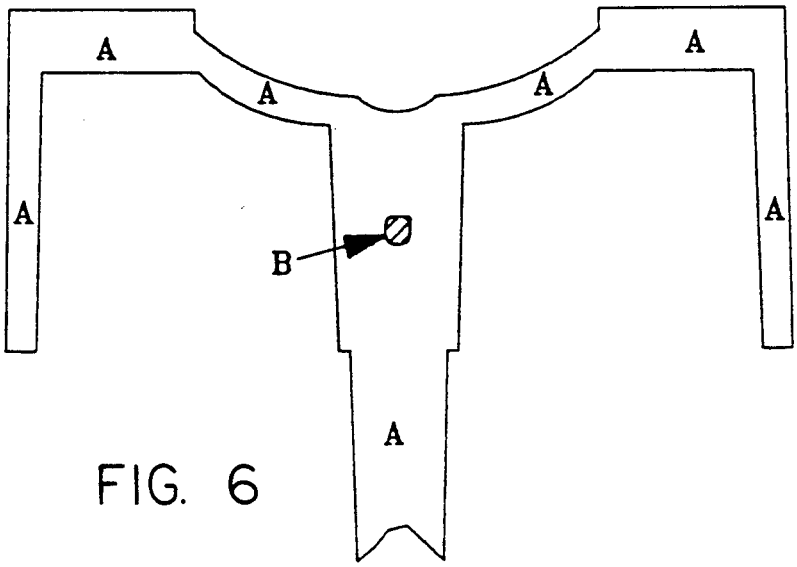
Figure 8:
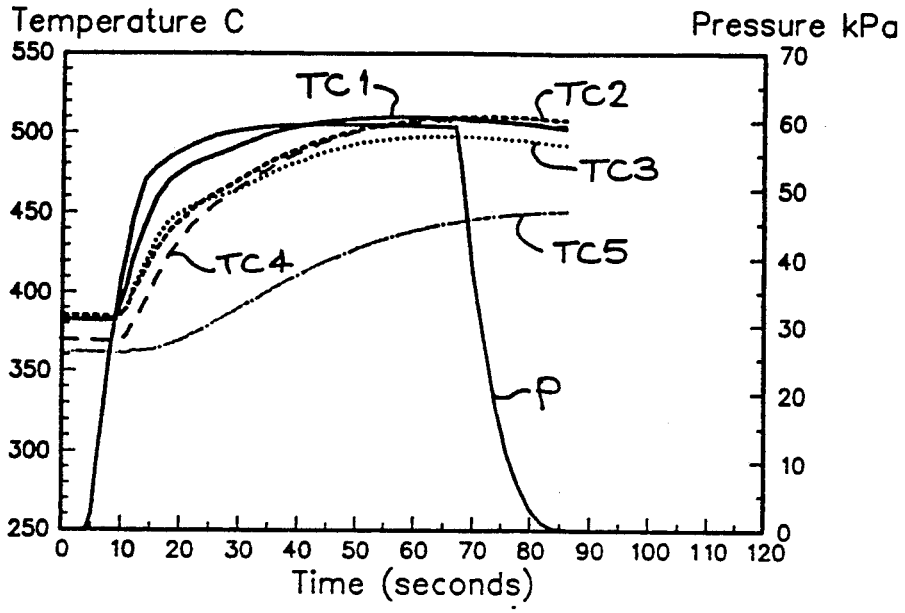
Figure 9:
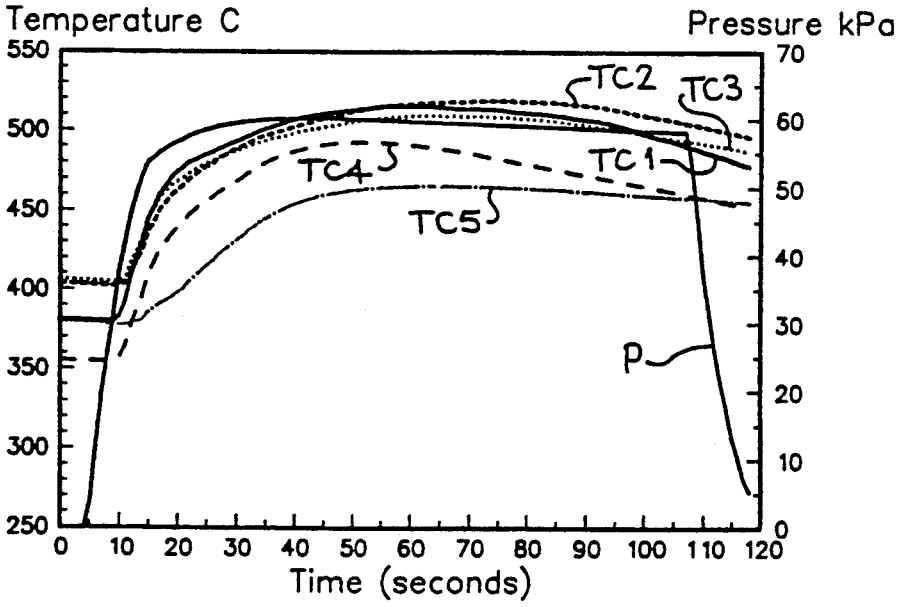
Figure 10:
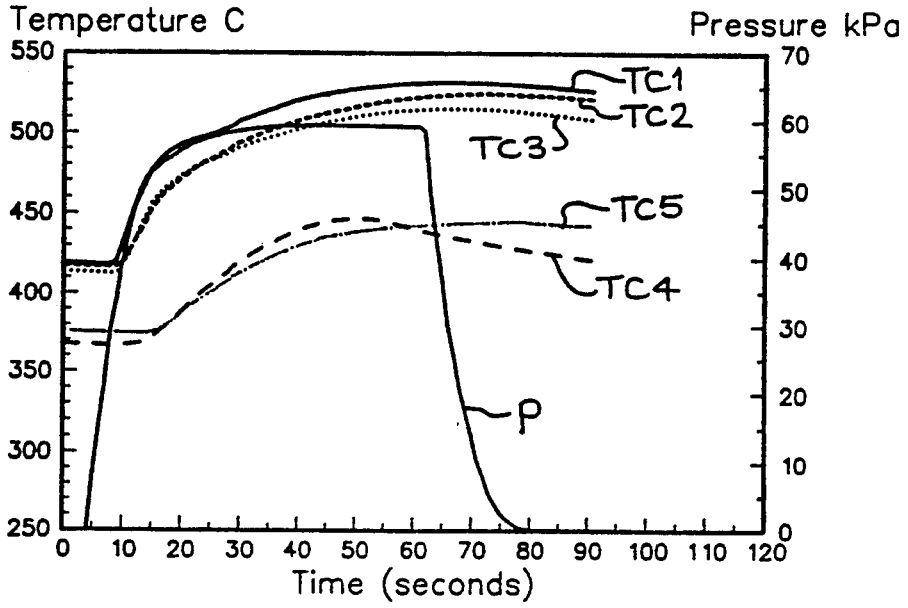
Figure 11:
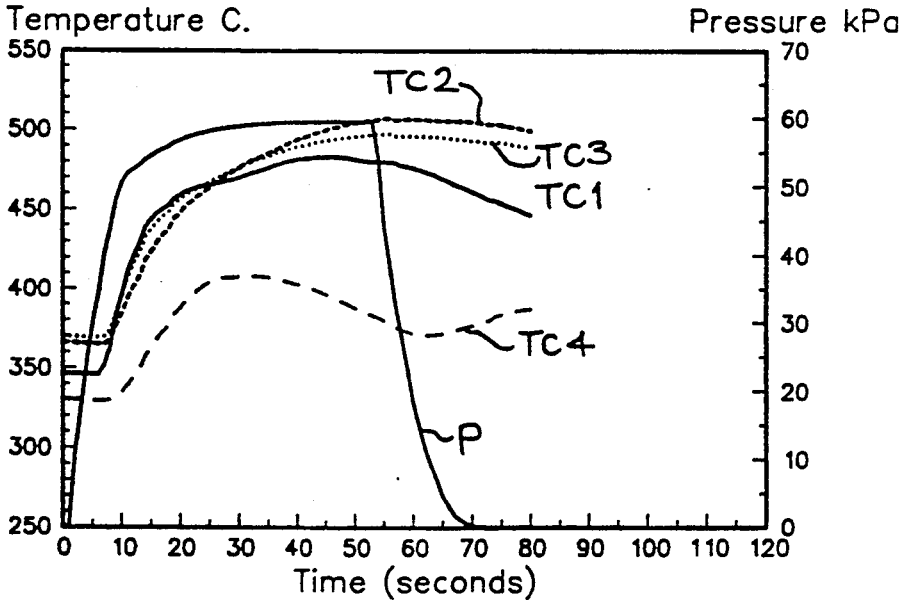
Figure 12:
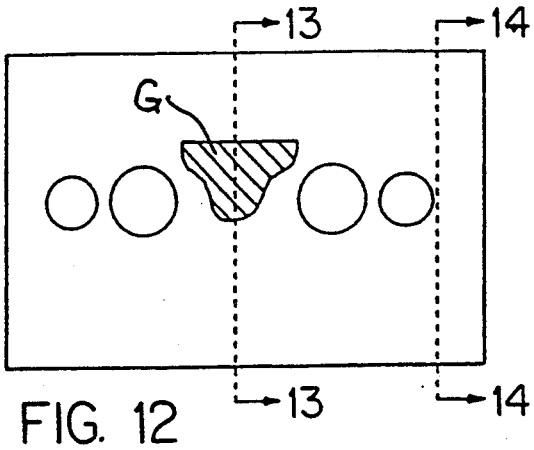
Figure 13:
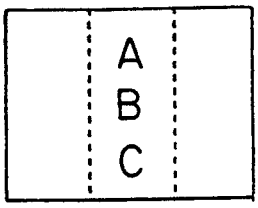
Figure 14:
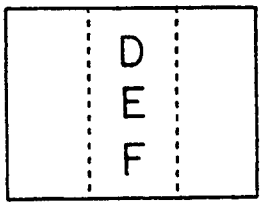
Figure 15:
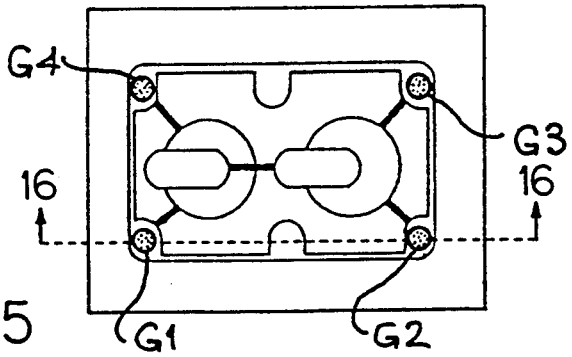
Figure 16:
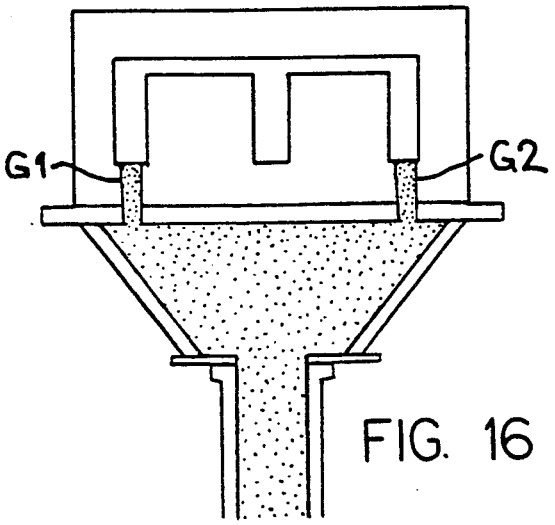

FIGS. 4 to 6 correspond to FIG. 5, but show the microstructure regions obtained respectively under conditions 3 to 5 of Example I;

FIGS. 7 to 11 are graphs illustrating variation of temperature and pressure with time, under respective conditions 1 to 5 of Example I;

FIG. 12 is a schematic representation of the form of cylinder head, shown from the deck or fire-face side, as cast in accordance with Example III;

FIGS. 13 and 14 show the location at which micrographs were prepared, respectively on sections 13—13 and 14—14 of FIG. 12;

FIGS. 15 and 16 are respective schematic representations of a low pressure casting die as used in casting simulated cylinder heads by the procedure of Example IV.

EXAMPLE I

Castings were made in a low pressure casting machine consisting of a 135 kg holding furnace able to be pressurised up to 157 kPa. A graphite riser tube was used to feed the molten metal to the mould. Furnace pressure was monitored by means of a pressure transducer in the furnace chamber.

To simplify procedure, the mould was for casting a simulated cylinder head designed so that the casting could be gated directly above the feeder tube or stalk, with air or air/water mist cooling able to be applied in the regions marked in FIG. 2. Several thermocouples, located 2 mm from the mould cavity surface, were installed in the mould to enable measurement of mould temperatures.

Figure 1:
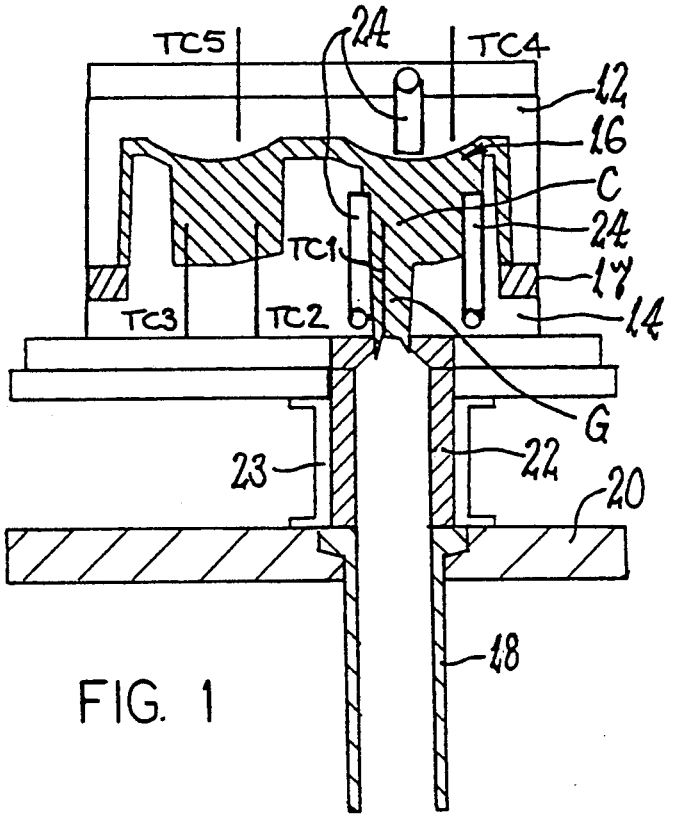
FIG. 1 is a schematic sectional view of a mould and feed system of a low pressure casting machine, used in the procedure of Example I.
Figure 7:
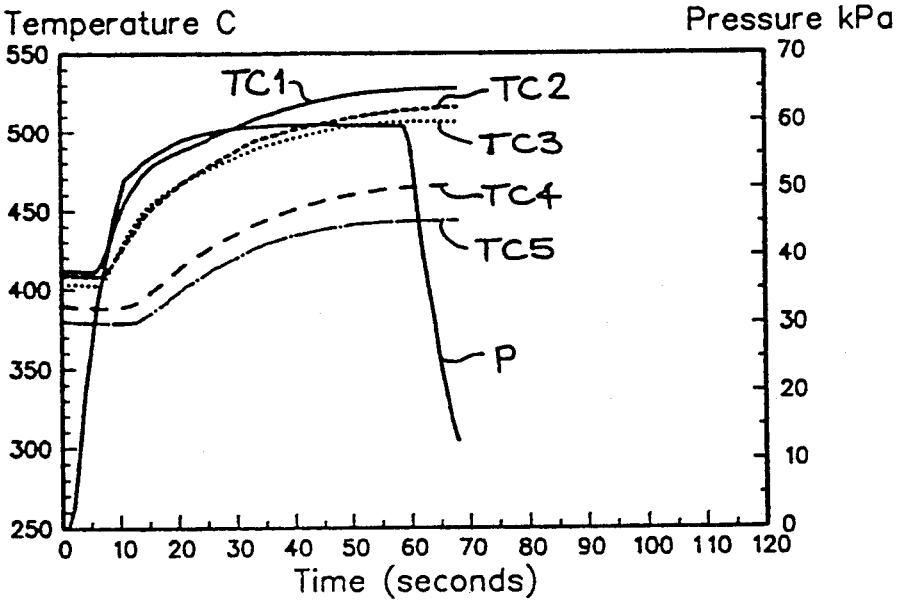

As shown in FIG. 1, the casting machine comprises upper and lower steel mould parts 12,14. Parts 12,14 define a mould cavity in which the cylinder head 16 was cast, and are separable after solidification of a casting at stripper plate 17. The molten metal was able to pass into the mould cavity, via graphite riser tube 18, through the furnace top 20, and then through tubular ceramic insert 22 in steel sleeve 23 and the gate G to a heavy section part of the casting in the control region C above the gate. Thermocouples TC1 to TC5 were positioned in the mould to enable temperature measurements to be obtained. Suitable channels 24 of a coolant circulation system were provided in mould parts 12,14, to enable extraction of heat energy from region C.

The casting conditions investigated are presented in Table I. All conditions measured were processed through a DT1001 Datataker able to be downloaded to a PC.

TABLE I

| CASTING DETAILS | | | | | |
|---|---|---|---|---|---|
| Condition: | 1 | 2 | 3 | 4 | 5 |
| Casting Temp. (°C.) | 740 | 740 | 740 | 740 | 740 |
| Mould Temp. (°C.) | 360 | 360 | 360 | 360 | 360 |
| Pressurisation Time (secs) | 75 | 60 | 55 | 50 | 50 |
| Mould Fill Time (secs) | 10 | 10 | 10 | 10 | 10 |
| Air Cooling (combustion chamber) | Off | On | On | On | On |
| Air Cooling (spark plug boss) | Off | Off | On | On | On |
| $H_2O$ Cooling (combustion chamber) | Off | Off | Off | On | On |
| $H_2O$ Cooling (spark plug boss) | Off | Off | Off | Off | On |

The casting conditions 1 to 5, of the respective columns of Table I, apply to respective castings. Following completion of each mould fill, the mould was allowed to stand for about 5 seconds to achieve quiescent conditions in the melt. Air cooling and/or air/water mist cooling (shown in Table I as "$H_2O$ Cooling") then was initiated at the end of the period of standing.

The castings were sectioned and samples were mounted and polished and then examined to determine the effects of the different casting conditions.

The castings were made from modified 3HA alloys, according to PCT/AU89/00054, as detailed in Table II. The alloys were maintained at ±0.05% of the indicated levels of Sr and ±0.01% of the level for Ti throughout the trials.

TABLE II

| ALLOY COMPOSITION (WT %) | | |
|---|---|---|
| | Conditions 1, 2 and 3 | Conditions 4 and 5 |
| Si | 13.8 | 13.8 |
| Cu | 2.1 | 2.1 |
| Ni | 2.01 | 2.0 |

TABLE II-continued

| ALLOY COMPOSITION (WT %) | | |
|---|---|---|
| | Conditions 1, 2 and 3 | Conditions 4 and 5 |
| Mg | 0.41 | 0.45 |
| Fe | 0.15 | 0.14 |
| Mn | 0.43 | 0.43 |
| Zr | 0.04 | 0.04 |
| Zn | <0.01 | <0.01 |
| Sr | 0.31 | 0.31 |
| Ti | 0.05 | 0.05 |
| Al | Balance * | Balance * |

* Note: apart from incidental impurities (with Ca and P each less than 0.003 wt % and all others less than 0.05 wt % each).

Three microstructures were typically present in the castings. These were designated A, B and C, where:

Type A = Fully modified plus negligible primary Si particles

Type B = Modified plus few primary Si particles

Type C = Unmodified plus many primary Si particles.

Figure 2A:
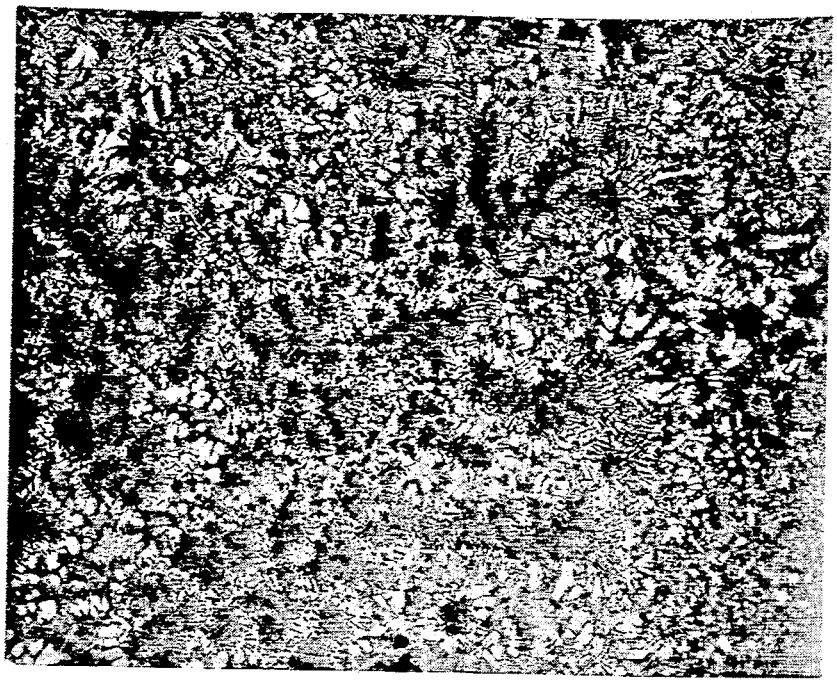
FIGS. 2A and 2B are respective photomicrographs showing the microstructure of simulated cylinder heads cast in the procedure of Example I.
Figure 2B:
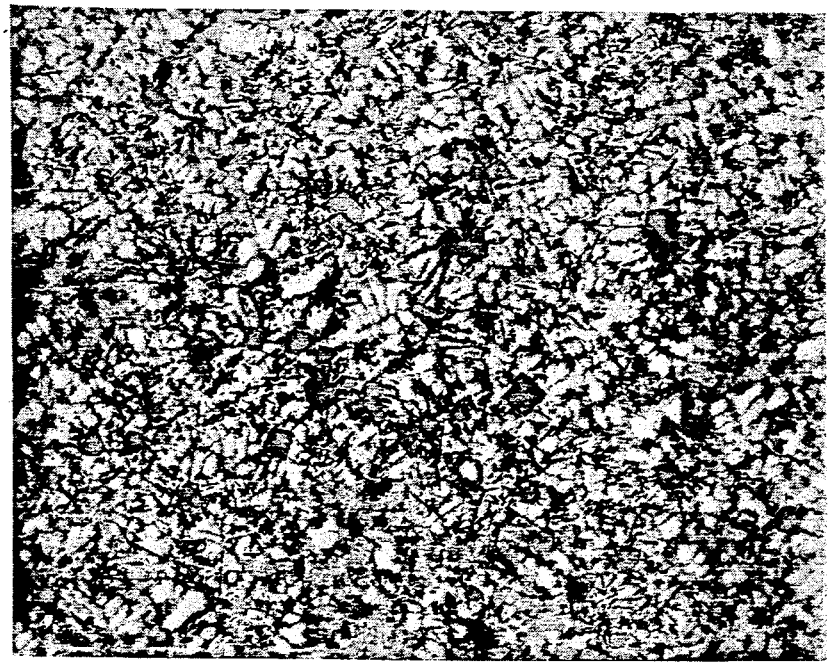

Typical microstructures A and C, obtained from castings in accordance with Example I, are shown by the photomicrograph of FIG. 2A and 2B respectively. These show these microstructures to be as typified above. While the microstructure B is not shown, its form will be apparent from a consideration of FIGS. 2A and 2B, given that it is intermediate these.

Figure 3:
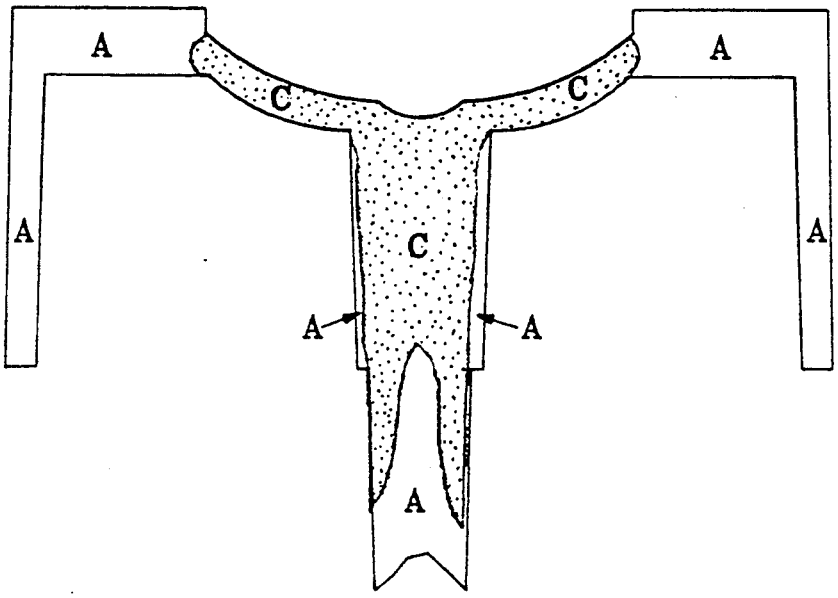
FIG. 3 is a schematic representation of a sectional view of a casting as in FIGS. 3A and 3B shown microstructure regions obtained under conditions 1 and 2 of Example I.

The microstructure of all castings examined in the area isolated from the gate was always type A, irrespective of casting conditions. However, the microstructure of the castings in the region adjacent to the gate varied with die temperature. When no cooling, or very limited cooling, was applied (conditions 1 and 2) the microstructure was chiefly type C (FIG. 3). The application of air cooling in the spark plug boss and combustion chamber areas improved the microstructure to chiefly type B, although some type C structure was still evident (FIG. 4).

Air/water mist cooling improved the microstructure considerably. When air/water mist cooling was applied to the combustion chamber, the microstructure in the control region adjacent to gate consisted chiefly of type A (FIG. 5). The application of air/water mist cooling to both the combustion chamber and the spark plug boss improved the microstructure even further to type A throughout the control region (FIG. 6).

The microstructure of all castings in the sprue area was consistently type A.

The results obtained with the castings are considered to make clear that high die temperatures in the regions adjacent to the gates in the simulated cylinder heads (under conditions 1 and 2) caused the poor microstructures in this area.

The control region adjacent to the gate is exposed to the entire volume of metal which flows into the die. Thus the gate is subject to overheating which, in turn, results in convection currents of sufficient intensity to disrupt the coupled growth mode of the Al-Si eutectic and to promote nucleation and growth of primary Si.

In the mould arrangement of FIG. 1, the air/water mist is provided by a fountain at each cooling system component shown. The fountains comprise conduits having an external diameter of from 6 to 6.5 mm, located approximately 5 mm from the surface of the mould cavity.

Operation of the coolant system, using air or air/water mist as specified for conditions 1 to 5 was such as to achieve cooling curves, as measured by thermocouples 1 to 5 of FIG. 1, shown in FIGS. 7 to 11, corresponding respectively to conditions 1 to 5. Thermocouple 5 was not operational during condition 5. The cooling curves show that in castings with type C microstructure in the control region (castings 1 to 4) the die temperature adjacent to the control region (thermocouple 1) is approximately 520° C. In castings with type A microstructure (casting 5) the temperature in the die adjacent to the control region has a maximum of about 470° C.

EXAMPLE II

Further castings were made under similar conditions to those of Example I, but using a gravity fed permanent mould and an alloy according to the known wear resistant alloy with adjustment of P content and addition of Sr and Ti as specified above. The alloy composition is set out in Table III.

TABLE III

| ALLOY COMPOSITION (WT %) | |
|---|---|
| | Conditions 1 to 5 |
| Si | 13.9 |
| Cu | 4.9 |
| Mg | 0.54 |
| Fe | 0.21 |
| Mn | 0.36 |
| Zr | 0.04 |
| Zn | <0.01 |
| Sr | 0.31 |
| Ti | 0.07 |
| Al | Balance * |

* Note: apart from incidental impurities (with Ca and P each less than 0.003 wt % and all others less than 0.05 wt % each).

The castings again were sectioned, mounted and polished, and then examined. The respective microstructures obtained were in good accord with those detailed above in Example I under the corresponding casting condition.

EXAMPLE III

Trial casting of a commercial form of cylinder head was carried out on an experimental low pressure casting machine. The die was modified to include a series of thermocouples and a cooling pin located within the gate region of the mould; with coolant fluid circulated through the cooling pin on completion of filling the mould. For the castings, 250 kg of alloy of the composition set out in Table IV was melted.

TABLE IV

| INGOT COMPOSITION (WT %) | | | |
|---|---|---|---|
| Si | 14.0 | Mn | 0.37 |
| Cu | 2.1 | Zr | 0.04 |
| Ni | 1.82 | Sr | 0.25 |
| Mg | 0.60 | Ti | 0.02 |
| Fe | 0.16 | Zn | <0.01 |

After melting the ingot, an addition of Sr was made to approximately 0.4 wt % Sr after which the melt was degassed to <0.22 cc/100 g and transferred to the holding furnace. A15Ti1B master alloy was added to the melt in the holding furnace just prior to casting to provide in the melt an additional 0.02 wt % Ti. Twenty six castings of the cylinder head then were made in total under conditions detailed in Table V (to be summarised).

TABLE V

| CASTING CONDITIONS | | | |
|---|---|---|---|
| Casting No. | Gate Pin Cooling | Metal Temp (°C.) | Control Region Structure* |
| 1 to 5 | Air | 725 | U/E and P/Si |
| 6 to 8 | Mist | 725 | U/E and P/Si |
| 9 | Air | 725 | U/E and P/Si |
| 10 and 11 | Air | 710 | U/E and P/Si |
| 12 to 17 | Water | 712 to 725 | M/E and isolated P/Si |
| 18 | Air | 690 | U/E and P/Si |
| 19 to 22 | Mist | 685 to 700 | U/E and P/Si |
| 23 to 25 | Air | 700 | UE and P/Si |
| 26 | Heavy Mist | 700 | Partly M/E and P/Si |

*UE denotes unmodified eutectic; P/Si denotes primary Si; and M/E denotes modified eutectic. The structure in areas remote from the gate consisted of M/E for all castings, regardless of die or metal temperature.

FIG. 12 is a schematic representation of a casting, showing the location of gate region G. Selected cylinder heads were sectioned and polished as illustrated in the representation of FIG. 12 of the deck or fire-face side of the head, to examine the effects of the different casting conditions. Sections 13—13 of FIG. 12 were taken to reveal the microstructure in the area above the gate G, while sections 14—14 of FIG. 12 were taken in the area away from the gate, at an end of each of the castings. Full sections of the area away from the gate were also examined macroscopically for porosity. Micrographs were prepared at locations A, B and C of sections 13—13 and D, E and F of section 14—14 as shown respectively in FIGS. 13 and 14.

The microstructure in the area located over the gate varied according to the amount of cooling applied and the metal temperature. Cooling was achieved by circulating coolant through the cooling pin located within the control region of gate G. Castings made with a relatively low degree of cooling in the control region above gate G, using air and mist, displayed poor microstructures. The eutectic was unmodified and many large primary Si particles varying in size from 20μ to 300μ were present. Maximum water cooling in the control region of gate G, using water and mist+water (or heavy mist), combined with metal temperatures greater than 700° C., resulted in castings consisting essentially of modified eutectic in the control region above gate G with a small amount of primary Si present in some areas of that region. The microstructure in areas remote from the gate consisted of modified eutectic for all the castings with various die thermal conditions and metal temperatures.

The results of the low pressure casting of Example III agree with those of Examples I and II. They show that cooling in the control region above the gate, whether by channels in the die or by a cooled core pin, influences the microstructure considerably. With an appropriate level of cooling, castings can be produced with modified eutectic structures throughout. However, in the castings of Example III, full water cooling in the control region was required to obtain an acceptable microstructure in the cylinder head being cast. Also in Example III, metal temperatures in the range 700°-710° C. gave satisfactory microstructures in the cylinder head castings.

The problem to which the present invention is directed, and the solution to the problem provided by the first embodiment of the present invention, is illustrated by the above Examples I to III. The problem is specifically illustrated by Examples I and II, under conditions 1 and 2 set out in Table I, of the first embodiment in respect of a modified 3HA alloy detailed in Table II and an example of the wear resistant alloy detailed in Table III.

The castings made in Examples I and II were made respectively in a low pressure casting machine using a permanent mould and a gravity fed permanent mould. In each case, the mould had a single gate through which all melt to form the castings was fed. The castings produced under conditions 1 and 2 thereof, with no cooling or very little cooling, had a microstructure of fully modified eutectic with negligible primary Si particles in regions remote from the gate but, above the gate, the microstructure was substantially unmodified with many primary Si particles. A slight improvement was achieved under conditions 3 and 4 providing mild cooling. In contrast, the stronger cooling provided under condition 5 achieve substantially fully modified eutectic throughout, with negligible primary Si particles, apart from a minor internal region of modified eutectic and few primary Si particles.

While excellent results are able to be achieved with the first embodiment, it adds to the complexity of operation with the requirement for cooling channels and for fluid flow and its control for cooling of the control region of the mould. The second embodiment enables essentially the same beneficial results to be achieved, at the sole expense of the need to determine and provide for the required number and spacing between gates For a casting the same as detailed in Example I, adequate heat distribution for such casting or about 3 kg. also has been obtained by use of at least one further gate, preferably a pair of spaced gates, for each heavy wall section of the casting, in accordance with the second embodiment. For any given casting, the number of gates and the spacing between these, are matters necessitating initial determination. However, for one form of commercial 4-cylinder engine block for an automobile engine, 5 to 6 uniformly spaced gates at heavy wall sections are likely to suffice, although more gates can be used.

EXAMPLE IV

The low pressure die castings of Examples I to III showed that poor microstructure developed in the control region above the gate unless cooling was applied to that region of the die. Example I showed that die temperatures in the control region above the gate could exceed 500° C. during filling, unless such cooling was applied. A build-up of heat in the control region significantly reduces the solidification rate but, more importantly, results in generation of intense convection currents in the control region which, in turn, promote poor microstructure. Examples I to III show that the heat build-up can be controlled with die cooling in the control region such that acceptable microstructures can be achieved in all regions of castings provided an appropriate level of cooling is applied to the gate region. The present Example illustrates another way to reduce the heat in the control region above the gate, using the second embodiment of the invention.

To examine the effects of the number of gates and the relative position, a low pressure casting die was modified to incorporate a pouring basin as shown in FIGS. 15 and 16, in which FIG. 16 shows the arrangement on sectional line a—a of FIG. 15. This allowed the casting to be gated through various positions, specifically at any of one or more of the four corners, as shown in FIGS. 15A and 15B by gates G1 to G4, without use of coolant fluid.

An ingot having a composition essentially as detailed in Table II for Example I was melted in a 135 kg furnace. Following composition checks, the casting die was lowered into place. The die was pre-heated using gas burners to approximately 350° C. A few cylinder head castings were made in quick succession to stabilise the die temperature. Typical conditions previously used in low pressure casting the cylinder head are presented in Table IV.

TABLE VI

| CASTING CONDITIONS USED FOR TRIAL | |
|---|---|
| Casting Temp. | 740° C. |
| Die Temp. | 360–400° C. |
| Die Fill Time | 15 secs. |
| Pressurisation time | 50 secs. |

These conditions are known to cause microstructure breakdown in the control region above the gate of the casting when no measures are taken to control heat build-up in this region. In the present Example the gating arrangement was varied to investigate the effects of filling the casting through one, two, three or four gates for cylinder heads cast through one, two, three or four gates.

All castings were sectioned to examine the effects of the different gating arrangements. Sections were taken from the control region directly above the or each gate and an area away from the gate at an outer edge. Two types of microstructure were typically present in the castings. These are designated Type A and Type C and correspond closely to the Type A and C structures detailed in Example I and shown in FIGS. 4A and 4B.

The microstructures of all castings examined in the areas away from the gates were typically Type A, irrespective of casting condition. The microstructure of the castings in the control region above the or each gate varied from Type C to A, depending on the number of castings made and the number of gates used as shown in Table VII. The maximum number of castings that could be made in a particular run was limited by the capacity of the furnace to 8 castings. With 3 or 4 gates, the maximum number of castings could be made without structure breakdown, with temperature measurements indicating that continued casting of cylinder heads with type A microstructure throughout would have been possible but for the furnace capacity limitation.

TABLE VII

MICROSTRUCTURE ASSESSMENT IN THE CONTROL REGION ABOVE THE GATE(S)

| Gating Arrangement | No. of Castings made prior to microstructure breakdown in control region(s) |
|---|---|
| One gate | 0 |
| Two gates | 4 |
| Three gates | 8 |
| Four gates | 8 |

The results indicate that the use of more than one gate, with appropriate spacing between the gates, is an effective way to extend the number of acceptable castings before microstructure breakdown occurs in the gate region.

In low pressure casting, convection currents are known to occur in the control region above the gate of the die. Such convection currents, resulting from high temperatures in the control region, are indicated to be the primary cause of microstructure breakdown. An arrangement of two or more suitably spaced gates in the die distributes the heat more uniformly and avoids localised heat build-up in the control region above each gate. The reduction in die temperatures causes the metal in each control region to solidify more rapidly. This reduces the effects of the convection currents and results in castings solidifying with fully eutectic microstructures. Thus a die with such gate arrangement, optionally with some die cooling, provides a means of achieving both soundness and correct microstructure in low pressure castings in hypereutectic alloy. While such arrangement enables attainment of a good structure throughout low pressure die castings, the number and spacing of the gates needs to vary with the size and shape of a specific casting.

The present invention thus is found to provide a solution to the problem of overheating in the control region of a permanent mould above the gate. With the enhanced control obtained by the invention, correct microstructure thus can be achieved throughout a cast article, including that portion thereof solidifying in the control portion of the mould cavity.

As indicated, the invention can be used with moulds comprising gravity and pressure fed permanent and semi-permanent moulds. Such moulds can be of metal of good thermal conductivity, such as steel, whether or not including non-permanent cores or the like. The mould can be bottom or side gated low or medium pressure diecasting moulds, or side or bottom gated gravity fed moulds, including gravity fed moulds adapted for top pouring through an external runner. Also, the invention can be applicable to top gated permanent moulds. Moreover, the invention readily is able to be varied to accommodate moulds for castings of a wide variety of configurations and sizes, within the overall spirit of the present disclosure.

Finally, it is to be understood that various alterations, modifications and/or additions may be introduced into the constructions and arrangements of parts previously described without departing from the spirit or ambit of the invention.

We claim:

1. A process for producing an article of an Al-Si hypereutectic alloy, in which the article is produced by feeding a melt of the alloy to a permanent mould, the process comprising the steps of:

(a) feeding the melt to a cavity of the mould through at least one gate, to fill the mould cavity by flow of the melt to remote regions of the cavity through a region of the mould, herein referred to as the "control region", which extends above and upwardly from the or each gate;

(b) maintaining the temperature in the control region below an upper level; and (c) controlling a temperature differential between the remote regions and the control region;

wherein the step of feeding the melt is controlled so that the melt as received in the die cavity has a feed temperature of not less than 700° C., and wherein the steps of maintaining the temperature of the control region and of controlling said temperature differential are achieved by at least one of extraction and distribution of heat energy from the or each control region, by causing flow of a fluid coolant through the control region to extract heat energy therefrom, such that:

(i) the mold walls of the remote regions on completion of filling of the mould cavity are at a temperature of from 150° to 350° C.;

(ii) the mold walls of the or each control region is at a temperature above that of the remote regions by at least 50° C.;

(iii) solidification of the melt in the mould is from the remote regions of the gate, through a portion of the melt within the control region of the mould;

(iv) the solidification proceeds substantially throughout the cavity, by coupled growth of eutectic, to achieve substantially throughout the resultant article a microstructure comprising modified eutectic; and (v) the melt in substantially all regions of the die cavity is able to solidify without strong convection currents and with a temperature gradient and resultant growth rate to achieve said coupled growth of Al-Si eutectic and said substantially uniform eutectic structure throughout.

2. A process for producing an article of an Al-Si hypereutectic alloy, in which the article is produced by feeding a melt of the alloy to a permanent mould, the process comprising the steps of:

(a) feeding the melt to a cavity of the mould through at least two gates, to fill the mould cavity by flow of the melt to remote regions of the cavity through a region of the mould, herein referred to as the "control region", which extends above and upwardly from each gate;

(b) maintaining the temperature in the control region below an upper level; and (c) controlling a temperature differential between the remote regions and the control regions;

wherein the step of feeding the melt is controlled so that the melt as received in the die cavity has a feed temperature of not less than 700° C., and wherein the steps of maintaining the temperature of the control regions and of controlling said temperature differential are achieved by selecting the number of and relative spacing between said gates for distribution of heat energy from each control region to other regions of the mould, such that:

(i) the mold walls of the remote regions on completion of filling of the mould cavity are at a temperature of from 150° to 350° C.;

(ii) each control region is at a temperature above that of the mold walls of the remote regions by at least 50° C.;

(iii) solidification of the melt in the mould is from the remote regions to the gates, through a portion of the melt within the control regions of the mould;

(iv) the solidification proceeds substantially throughout the cavity, by coupled growth of Al-Si eutectic, to achieve substantially throughout the resultant article a microstrcture comprising modified eutectic; and (v) the melt in substantially all regions of the die cavity is able to solidify without strong convection currents and with a temperature gradient and resultant growth rate to achieve said coupled growth of Al-Si eutectic and said substantially uniform eutectic structure throughout.

3. The process of claim 1 or claim 2, wherein the heat energy is extracted, distributed, or extracted and distributed such that the article has a substantially uniform microstructure throughout at least with respect to constituents of the microstructure, and also with respect to size, such that the microstructure is substantially of modified eutectic throughout and substantially free of primary Si particles, with the eutectic cell size, and also the size of any primary Si particles formed, also substantially uniform throughout.

4. The process of claim 1 or claim 2, wherein the temperature of the mould is monitored at the or each control region, and also at remote regions.

5. The process of claim 1, wherein the mold walls of the or each control region is at a temperature above that of the remote regions by at least 75° C.

6. The process of claim 1 or claim 2, wherein the mold walls of the remote regions of the mould, on completion of filling the mould cavity, are at a temperature of from 200° to 350° C.

7. The process of claim 1 or claim 2, wherein the mold walls of the or each control region of the mould is at a temperature of from 350° to 520° C.

8. The process of claim 1 or claim 2, wherein the melt as received in the die cavity has a feed temperature of not less than 720° C.

9. The process of claim 1, wherein the flow of coolant is initiated substantially on completion of filling the mould cavity such that substantial heat energy extraction by the flow of coolant is achieved on or shortly after completion of filling of the mould cavity.

10. The process of claim 9, wherein the flow of coolant is initiated after a short interval following the completion of filling of the mould cavity, with the mould being allowed to stand during that interval.

11. The process of claim 10, wherein the period of standing is from a few seconds up to about 10 seconds.

12. A process of claim 1, wherein the fluid coolant is selected from air, nitrogen, liquids such as water, water containing a dissolved salt or other compound to increase its thermal capacity, oil, and water/oil mixtures.

13. The process of claim 12, wherein the coolant comprises a liquid mist of water or oil carried by a gas stream.

14. The process of claim 13, wherein flow of the gas stream through the or each control region of the mould is commenced before commencing flow of the liquid, with flow of the liquid being terminated in advance of terminating the flow of the gas stream on completion of cooling.

15. The process of claim 2, wherein the number and positioning of the gates is adjusted such that the maximum temperature prevailing in the control regions is compatible with avoidance of convection currents which prevent attainment of coupled growth, during solidification of the melt, throughout substantially the entire mould cavity, thereby achieving a substantially uniform microstructure throughout, with control of the temperature prevailing in the control regions such that solidification of the melt progresses to the gates from regions of the cavity remote from the gate, but such that excessive cooling of the melt in the control portion does not occur in advance of such solidification, and such that shrinkage and resultant porosity in the casting is substantially precluded.

16. The process of claim 1 or claim 2, wherein said alloy has from 12 to 16 wt % Si.

17. The process of claim 16, wherein said alloy comprises 12 to 15 wt % Si; 1.5 to 5.5 wt % Cu; 1.0 to 3.0 wt % Ni; 0.1 to 1.0 wt % Mg; 0.1 to 1.0 wt % Fe; 0.1 to 0.8 wt % Mn; 0.01 to 0.1 wt % Zr; and 0.01 to 0.1 wt % Ti; the balance apart from Si modifier and incidental impurities being Al; with said modifier being Sr in excess of 0.1 wt % up to at least 0.4 wt %.

18. The process of claim 17, wherein said alloy has 12 to 15 wt % Si; 1.5 to 4.0 wt % Cu; 1.0 to 3.0 wt % Ni; 0.4 to 1.0 wt % Mg; 0.1 to 0.5 wt % Fe; 0.1 to 0.8 wt % Mn; 0.01 to 0.1 wt % Zr; and 0.01 to 0.1 wt % Ti.

19. The process of claim 16, wherein said alloy comprises 12 to 16 wt % Si; 1.5 to 5.5 wt % Cu; 1.0 to 3.0 wt % Ni; 0.1 to 1.0 wt % Mg; 0.1 to 1.0 wt % Fe; 0.1 to 0.8 wt % Mn; 0.01 to 0.1 wt % wt % Zr; 0.01 to 0.1 wt % Ti; P at a level of up to 0.05 wt % maximum; Ca limited to a maximum of 0.03 wt %; and Sr in excess of 0.1 wt % up to at least 0.4 wt %; the balance apart from incidental impurities comprising Al.

20. The process of claim 16, wherein said alloy comprises 12 to 16 wt % Si; Sr in excess of 0.10% and Ti in excess of 0.005%, the alloy further comprising 1.5 to 5.5 wt % Cu; 1.0 to 3.00 wt % Ni; 0.1 to 1.0 wt % Mg; 0.1 to 1.0 wt % Fe; 0.1 to 0.8 wt % Mn; 0.01 to 0.1 wt % Zr; 0 to 3.0 wt % Zn; 0 to 0.2 wt % Sn; 0 to 0.2 wt % Pb; 0 to 0.1 wt % Cr; 0 to 0.01 wt % Na; ≦0.05 wt % B (elemental); ≦0.03 wt % Ca; ≦0.05 wt % P; ≦0.05 wt % each for others; the balance, apart from incidental impurities, being Al; wherein the level of Sr in excess of 0.1% and Ti in excess of 0.005% is such that the alloy has a microstructure in which any primary Si formed is substantially uniformly dispersed and is substantially free of segregation, and in which substantially uniformly dispersed Sr intermetallic particles are present but are substantially free of such particles in the form of platelets, the microstructure predominantly comprising a eutectic matrix.

21. The process of claim 20, wherein Sr is present at a level of from 0.11% to 0.4%; Ti is present as at least one of $(Al,Ti)B_2$, $TiB_2$, $TiAl_3$, TIC and TiN, provided that not more than 0.1% Ti is provided as any of $(Al,Ti)B_2$, $TiB_2$ and mixtures thereof.

22. The process of claim 16; wherein the alloy has 12% to 16% Si, and elements A, X and Z with the balance, apart from incidental impurities, being Al; the alloy having at least one element X and at least one element Z in excess of a respective predetermined level for each such that the alloy has a microstructure in which any primary Si present is substantially uniformly dispersed, with the microstructure predominantly comprising a eutectic matrix; and the elements A comprising 1.5 to 5.5 wt % Cu; 1.0 to 3.0 wt % Ni; 0.1 to 1.0 wt % Mg; 0.1 to 1.0 wt % Fe; 0.1 to 0.8 wt % Mn; 0.01 to 0.1 wt % Zr; 0 to 3.0 wt % Zn; 0 to 0.2 wt % Sn; 0 to 0.2 wt % Pb; 0 to 0.1 wt % Cr; 0.001 to 0.1 wt % Si modifier; 0.05 wt % maximum B (elemental); 0.03 wt % maximum Ca; 0.05 wt % maximum P; 0.05 wt % maximum each other; the element X being at least one selected from a group providing stable nucleant particles in a melt of the alloy; and the element Z comprising at least one selected from a group which forms an intermetallic phase; the element X not being solely Ti where element Z is solely Sr.

23. The method according to claim 22, wherein the element X is selected from the group comprising Cr, Mo, Nb, Ta, Ti, Zr, V and Al and is present at a level in excess of 0.005 to 0.20 wt %, provided that where the element X is Ti added as an Al-Ti-B master alloy the upper limit preferably does not exceed 0.1 wt %; the element Z being selected such that the intermetallic phase is ternary or higher order phase of the form Al-Si-Z' or Al-Z', where Z' is at least one element Z and selected from Ca, Co, Cr, Cs, Fe, K, Li, Mn, Na, Rb, Sb, Sr, Y, Ce, elements of the Lanthanide series, elements of the Actinide series, and mixtures thereof.

24. An article produced by the process of claim 1 or claim 2.

* * * * *